US005161084A

United States Patent [19]

Morihara et al.

[11] Patent Number: 5,161,084

[45] Date of Patent: Nov. 3, 1992

[54] APPARATUS FOR CONTROLLING AN OUTPUT OF CHARGERS FOR USE IN IMAGE FORMING APPARATUS

[75] Inventors: Kazushige Morihara, Kawasaki; Masashi Kimura, Yokohama; Shin Yamauchi, Tokyo, all of Japan

[73] Assignee: Kabushiki Kaisha Toshiba, Kawasaki, Japan

[21] Appl. No.: 466,586

[22] Filed: Jan. 17, 1990

[30] Foreign Application Priority Data

Mar. 23, 1989 [JP] Japan ..... 1-71445

[51] Int. Cl.[5] ..... G03G 15/00

[52] U.S. Cl. ..... 361/225; 355/208; 355/216; 355/219

[58] Field of Search ..... 361/225; 355/208, 216, 355/219

[56] References Cited

U.S. PATENT DOCUMENTS

| | | | |
|---|---|---|---|
| 3,887,845 | 6/1975 | Michatels | 355/208 |
| 4,133,610 | 1/1979 | Bernardelli et al. | 355/208 |
| 4,341,457 | 7/1982 | Nakahata et al. | 355/208 |
| 4,411,514 | 10/1983 | Komori et al. | 355/208 |
| 4,563,081 | 1/1986 | Sato | 355/14 |
| 4,564,287 | 1/1986 | Suzuki et al. | 355/208 |
| 4,607,937 | 8/1986 | Minami | 361/255 |
| 4,672,505 | 6/1987 | Tsuchiya et al. | 361/225 |
| 4,814,823 | 3/1989 | Abuyama et al. | 355/208 |
| 4,994,855 | 2/1991 | Ohashi et al. | 355/219 |

FOREIGN PATENT DOCUMENTS

| | | |
|---|---|---|
| 109722 | 5/1984 | European Pat. Off. . |
| 2934337 | 2/1980 | Fed. Rep. of Germany . |
| 3319543 | 12/1983 | Fed. Rep. of Germany . |
| 3304966 | 10/1986 | Fed. Rep. of Germany . |
| 60-247173 | 12/1985 | Japan . |

*Primary Examiner*—Steven L. Stephan
*Assistant Examiner*—Thomas M. Dougherty
*Attorney, Agent, or Firm*—Foley & Lardner

[57] ABSTRACT

A charger for initial charging is built on the surface of a photosensitive drum. A discharge lamp removes the charge from the photosensitive drum. A current detection unit detects the current flowing from the photosensitive drum upon the removal of the charge from the surface of the photosensitive drum by the discharge lamp. A control unit compares a current which is detected by a current detection unit with a reference value which is initially stored in a memory and generates a digital value corresponding to a difference error between them. An A/D converter converts the digital value which is generated from the control unit into an analog current for supply to the first-mentioned charge. The aforementioned process is repeated by an instruction of the control unit until the difference value between the current detected by the current detection unit and the reference value comes within an allowable range.

15 Claims, 4 Drawing Sheets

APPARATUS FOR CONTROLLING AN OUTPUT OF CHARGERS FOR USE IN IMAGE FORMING APPARATUS

BACKGROUND OF THE INVENTION

1. Field of the Invention

The present invention relates to an image forming apparatus, such as an electronic copying machine, using a photosensitive drum, for instance, and, in particular, an apparatus for controlling the output of chargers located around the photosensitive drum.

2. Description of the Related Art

In an image forming apparatus using a photosensitive drum, an amount of charge on the photosensitive drum differs for each photosensitive drum used, even if the same voltage is applied to a charger. It is, therefore, necessary to control, in accordance with the respective photosensitive drum, the outputs of a charger for initial charging, a charger for transfer and a charger for separation, which are arranged around the photosensitive drum.

It has been the common practice, if the outputs of these chargers around the photosensitive drum are to be controlled, to control the supply voltage to the chargers in accordance with the surface potential measured by a surface electrometer on the surface of the photosensitive drum. It is, however, not advisable to provide the surface electrometer within the copying machine because it is large and expensive.

A means of controlling the outputs of chargers, using a special jig, has been developed to avoid the aforementioned drawback. In the case where the outputs of the chargers are to be controlled, the photosensitive drum is removed from the copying machine and an aluminum jig of a similar configuration is mounted there. A corona discharge is then created on the jig and a current value or voltage value obtained from the jig is measured for coincidence with the predetermined value. By so doing, a variable resistance across a high voltage transformer which is connected to the charger is manually controlled. However, the manual control operation using the aforementioned jig has proved difficult to use in comparison with an actual control on the photosensitive drum, and also time-consuming.

Since the size of the photosensitive drum is different from machine to machine, it has been necessary to prepare a plurality of jigs in accordance with the size of the photosensitive drum and change them accordingly. Therefore, a cumbersome control operation is required.

SUMMARY OF THE INVENTION

It is accordingly the object of the present invention to provide an output control apparatus for chargers, for use in an image forming apparatus which can properly and automatically control the output of the charger for a brief period of time on a photosensitive drum without the need to replace the drum with a corresponding jig.

The object of the present invention is achieved by the following structure. That is, according to the present invention, there is provided an apparatus for controlling the outputs of the chargers for use in an image forming apparatus which comprises:

charging means for building a charge on an image carrying member;

discharging means for removing the charge, which is built on the image carrying member;

means for designating the output control of the charging means;

means, in the event which the output control of the charging means is designated by the designating means, for detecting a signal which flows from the image carrying member upon the charging and discharging being made by the charging and discharging means, respectively; and means for controlling an output of the charging means until the detection output of the detecting means reaches a predetermined value or falls within an allowable ramp.

According to the present invention, the output control of the charging means can be properly performed directly on the image carrier without using any corresponding special jig.

Output control of the charging means can be achieved for a brief period of time without the need for replacing the image carrier with a corresponding special jig.

The output control of the chargers can be automatically performed by making a corresponding designation by a designating means.

The output control of the chargers can be accurately achieved since, upon the designation being made by the designating means thereto, the developing means and cleaning means are moved by the driving means away from the image carrier.

DESCRIPTION OF THE PREFERRED EMBODIMENTS

Figure 1:
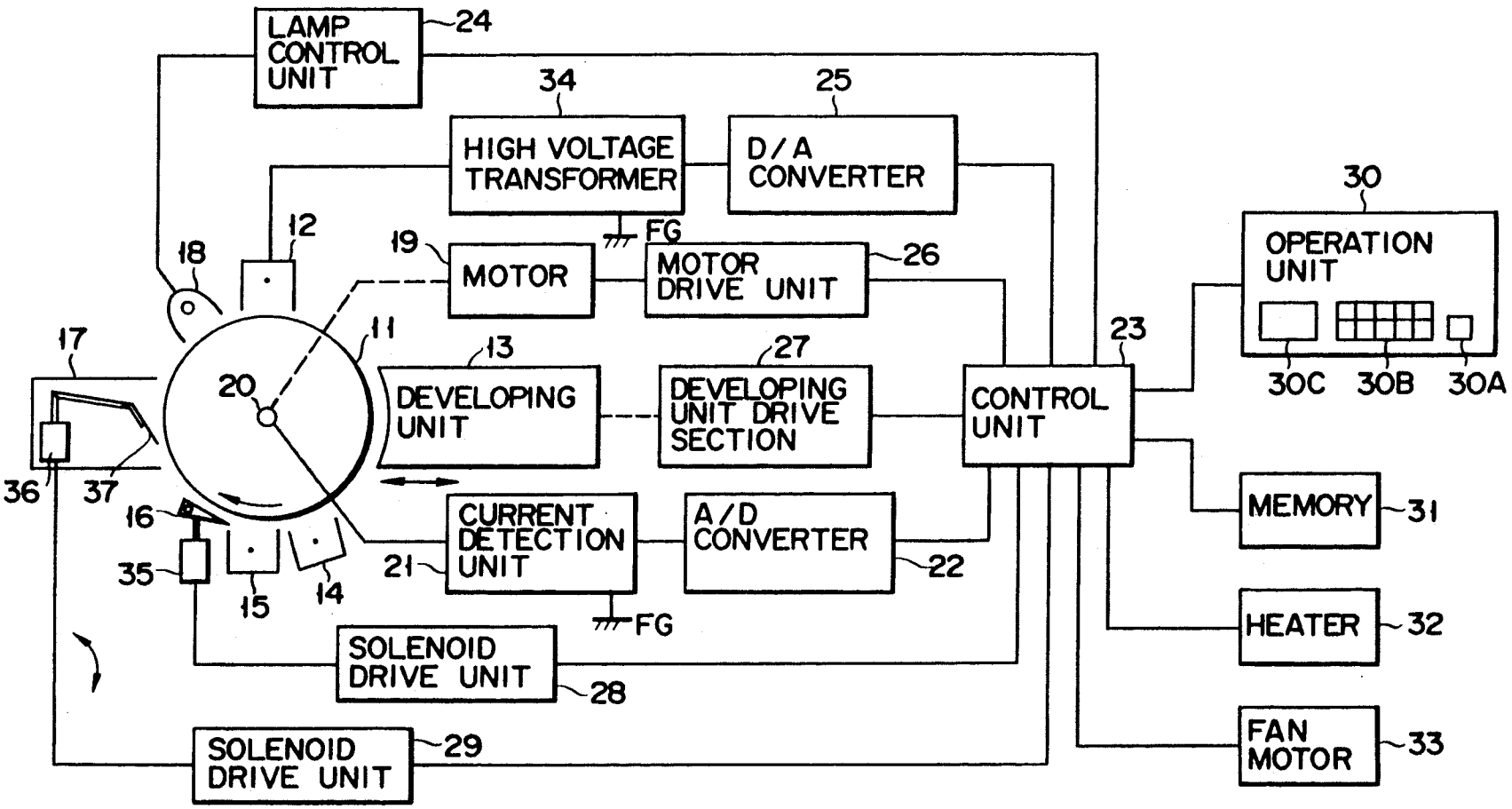
FIG. 1 is a block diagram showing a major section of an apparatus according to a first embodiment of the present invention.

The embodiments of the present invention will be explained below with reference to the accompanying drawings. FIG. 1 shows a major section of an electronic copying machine to which the present invention is applied.

Around a photosensitive drum are located a charger 12 for initial charging, which imparts a charge to a photosensitive drum 11, a developing unit 13 for attaching a developing agent to an electrostatic latent image on a photosensitive drum to develop it into a visual image, a transfer charger 14 for transferring the visual image to a paper sheet, a separation charger 15 for electrically separating from the photosensitive drum 11 the paper sheet with the visual image thereon transferred by the transfer charger, a separation blade 16 for allowing the paper sheet which is electrically separated by the separation charger 15 to be mechanically separated from the photosensitive drum 11, a cleaning unit 17 for cleaning the developing agent remaining on the surface of the photosensitive drum 11, and a discharge lamp 18 for removing the residual charge on the photosensitive drum 11.

The photosensitive drum 11 is rotated by a motor 19, in a direction as indicated by an arrow in FIG. 1, with a conductive support 20 as a reference. A current detection unit 21 is electrically connected to the conductive support 20 to detect a current flowing from the photosensitive drum 11 to ground FG through the conductive support 20 upon the control of the charger 12.

Figure 2:
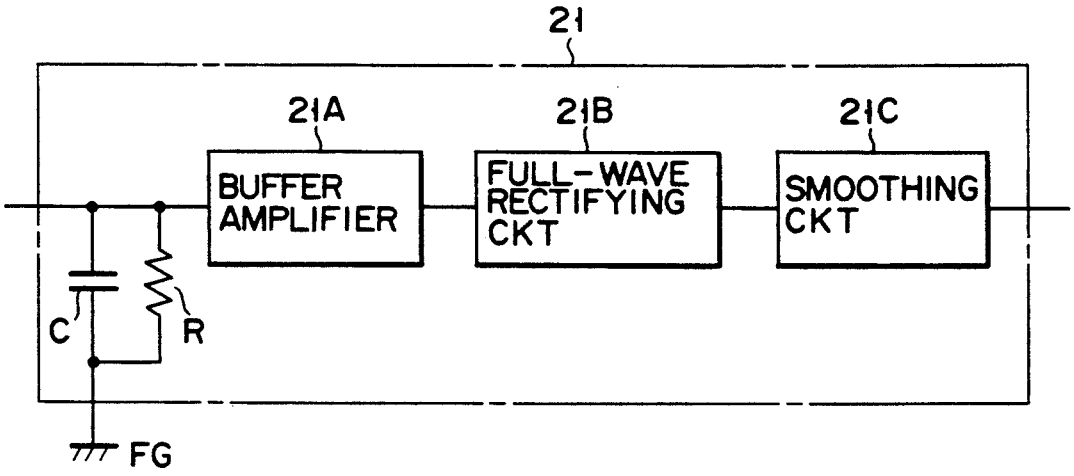
FIG. 2 is a block diagram showing a current detection circuit in the embodiment shown in FIG. 1.

FIG. 2 shows the current detection unit 21.

The current detection unit 21 comprises a parallel circuit of a capacitor C and resistor R which is connected between the conductive support 20 and ground, a buffer amplifier 21A for amplifying a voltage which is generated in accordance with a current flowing across the resistor R, a full-wave rectifying circuit 21B for full-wave rectifying an output voltage of the buffer amplifier 21A, and a smoothing circuit 21C for smoothing an output voltage of the full-wave rectifying circuit.

The output of the current detection unit 21 is connected through an A/D converter 22 to a control unit 23, as shown in FIG. 1.

The control unit 23 controls the operation of the copying machine. The control unit 23 is connected, for example, to a lamp control unit 24, a D/A converter 25, a motor drive unit 26, a developing unit drive section 27, solenoid drive units 28, 29, an operation panel 30, a memory 31, a heater 32 for a fixing unit, not shown, and a fan motor 33 for driving a fan which circulates air in the copying machine.

The lamp control unit 24 is adapted to control the lighting of the discharge lamp 18.

The D/A converter 25 converts a digital signal which is supplied from the control unit 23 into an analog signal and supplies it to the high voltage transformer 34. The high voltage transformer supplies a predetermined current or voltage to the charger 12 in accordance with the analog signal of the D/A converter 25.

The developing unit driving section 27 is adapted to move the developing unit 13 into and out of engagement with the photosensitive drum 11.

The solenoid drive unit 28 drives a solenoid 35 which in turn rotates the separation blade 16.

The solenoid drive unit 29 drives a solenoid 36, constituting the cleaning unit 17, which in turn moves a cleaning blade 37 into and out of contact with the surface of the photosensitive drum 11.

The operation panel 30 includes, for example, a copying key 30A for supporting a start of copying, ten keys 30B for setting the number of copying sheets used and an output control mode etc., of the charger as will be set forth below, and a display unit 30C for displaying the number of copying sheets etc., which is entered by the ten keys 30B.

The memory 31 contains, for example, an output control value of the charger and a program for controlling the operation of the control unit 23.

Figure 3:
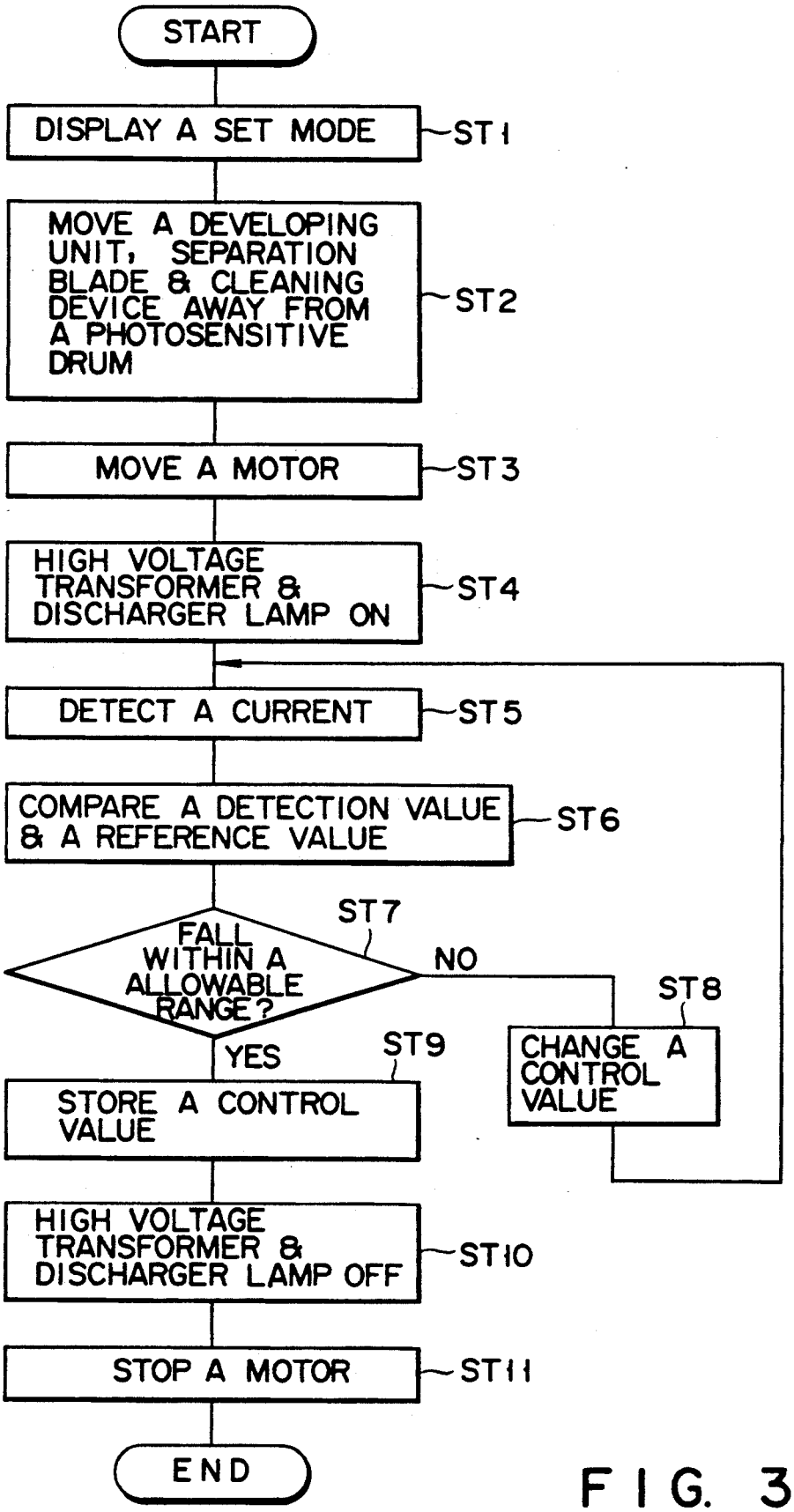
FIG. 3 is a flowchart for explaining the operation of the apparatus of FIG. 1.

The output control operation of the charger 12 in the aforementioned arrangement will be explained below with reference to FIG. 3.

Upon the entering of the charger output centro code via the ten keys 30B on the operation panel 30, the control unit 23 sets an output control mode of the charger. Upon receipt of an output control mode, the control unit 23 executes an operation as shown in FIG. 3.

First, the output control mode is displayed on the display unit 30C of the operation panel 30 (steps ST1). In this state, the developing unit 13 is moved by the drive section 27 away from the photosensitive drum 11 and the solenoids 35 and 36 are operated by the solenoid drive units 28, 29, respectively, moving the separation blade 16 and cleaning blade 37 away from the photosensitive drum 11 (step ST2). The heater 32 of the fixing unit is turned OFF and the fan motor 33 is stopped (step ST2).

The motor 19 is driven by the motor drive unit 26 (step ST3). Reference data which is initially stored in the memory 31 is supplied by the control unit 23 to the D/A converter 25. Upon receipt of the reference data, the D/A converter 25 converts it into an analog signal which is in turn supplied to the high voltage transformer 34. That is, the high voltage transformer 34 is operated in accordance with a predetermined analog signal, causing a charge to be formed by the charger 12 on the surface of the photosensitive drum 11. At the same time, the discharge lamp 18 is lit by the lamp control unit 24 In this way, a corona discharge step and discharge step are sequentially performed (step ST4).

On the other hand, current flowing from the photosensitive drum 11 to ground FG through the conductive support 20 (a current from the conductive support 20 into the photosensitive drum 11 in the case of a charge of an opposite polarity) is detected by the current detection unit 21 whose output is supplied via the A/D converter 22 to the control unit 23 (step ST5). The control unit 23 compares the detection value with the reference value initially stored in the memory 31 (steps ST's 6, 7). If the detection value is outside an allowable range of the reference value, the control unit 23 delivers, for example, a digital value "128" as a control value to the D/A converter 25 (step ST8). The D/A converter 25 generates a control current (or a control voltage) corresponding to the digital value and delivers it to the high voltage transformer 34. Upon receipt of an output from the high voltage transformer 34, the charger 12 again conducts a corona discharge step. In this way, the steps ST's 5 to 7 are carried out.

That is, the corona discharge step and discharging step are sequentially conducted by the charger 12 and discharge lamp 18, respectively, and a current flowing from the photosensitive drum 11 is detected by the current detection unit 21. The detection value is compared by the control unit 23 with the reference value. The control unit 23 delivers, for example, a digital value "192" as a control value when the detection value is lower than the reference value and, for example, a digital value "64" as a control value when the detection value is higher than the reference value. In this way, steps ST's 5 to 8 are carried out.

By so doing, the control value is sequentially set in accordance with a difference error between the detection value and the reference value and, in this way, converged into the allowable range of the reference value.

Figure 4:
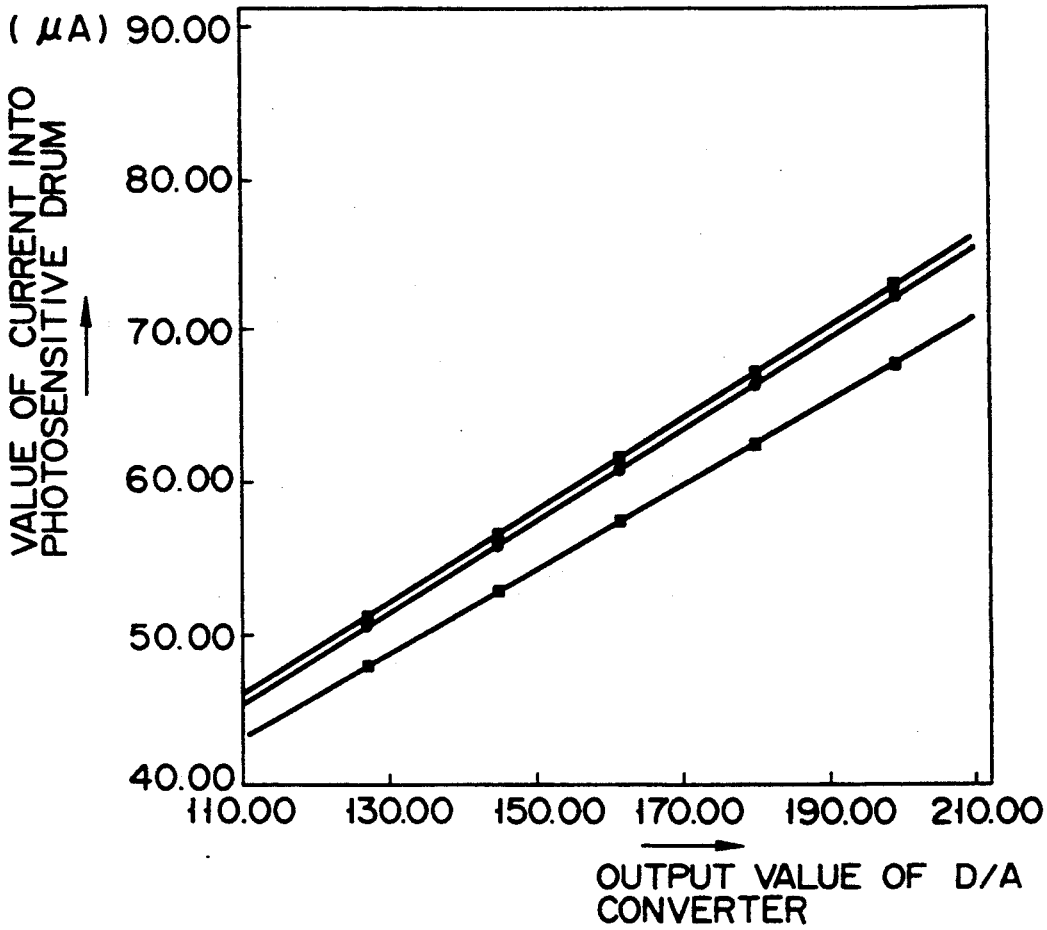
FIG. 4 is a characteristic diagram showing the relation of the value of a current relative to a photosensitive drum to an output value of the A/D converter.

FIG. 4 is a graph showing a relation of a current into three kinds of photosensitive drums to an output value of the D/A converter 25.

If the detection value falls within the allowable range of the reference value or reaches a predetermined value (step ST7), the control value at that time is stored in the memory 31 (step ST9). The high voltage transformer 34 and discharger lamp 18 are turned OFF and the motor 19 is stopped, completing an output control operation (step ST's 10 and 11).

Then when a normal copying operation is to be performed, a charging output value of the charger 12 is set based on the control value which is involved at the completion of the control cycle.

According to the present embodiment, the output control of the charger is carried out using the photosensitive drum. Since, therefore, the conventional jig is not required, an exchange of the photosensitive drum for the jig can be saved in the event of controlling an output of the charger. Furthermore, an amount of charge can be set in a manner to correspond to the photosensitive drum in actual use, thus assuring an accurate control.

With the control unit 23 set in an output control mode, the developing unit 13, separation blade 16 and cleaning blade 37 are moved away from the photosensitive drum 11 and the heater 32 of the fixing unit is turned OFF in which case the fan motor 33 is stopped. If the drum 11 is rotated at the time of controlling the output of the charger, it is yet possible to prevent a control error resulting from the toner of the developing unit 13, prevent a twist of the cleaning blade 37 and prevent a change in ambient temperature in the copying machine resulting from the fixing unit and fan. It is thus possible to perform accurate output control.

Further, setting the control unit 23 in the output control mode allows automatic output control, thus obviating the need to manually control a variable resistance across the high voltage transformer in accordance with the result of detection as in the prior art. It is thus possible to readily perform such control operation for a brief period of time without involving a variation as introduced due to a human factor, such as control by an operator.

The control value which is obtained by the controlling operation is stored in the memory 31, and utilized as a control value for the next control operation time so that the control operation may be started. Since, therefore, control operation can be performed based on less control error between the control value and the reference value, it is possible to shorten control time required.

Figure 5:
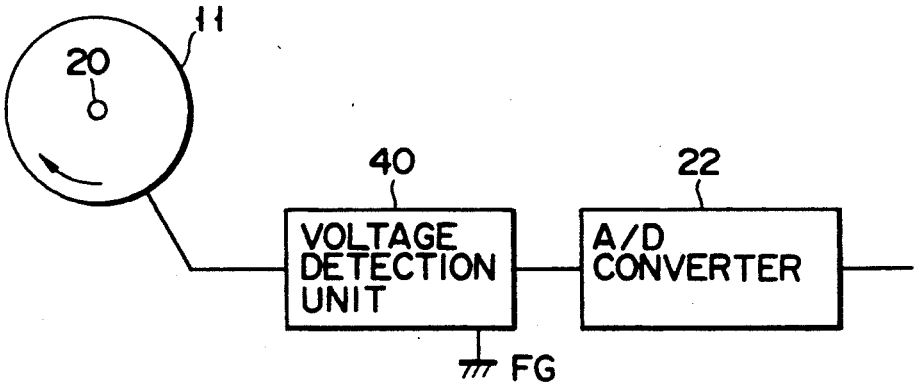
FIG. 5 is a block diagram showing a major section of an apparatus according to a second embodiment of the present invention.

FIG. 5 shows a second embodiment of the present invention.

Although, in the aforementioned embodiment, a current which flows from the photosensitive drum 11 has been explained as being detected by the current detection unit 21, the embodiment of FIG. 5 may be of such a type that a voltage on the photosensitive drum 11 is detected by a voltage detection unit 40 and converted by an A/D converter 22 to a digital signal for supply to the control unit 23.

This embodiment can gain the same advantage as set forth above in conjunction with the previous embodiment.

Although, in the aforementioned embodiment, the control operation of the charger 12 has been explained in connection with the present invention, the present invention is not restricted to the aforementioned embodiments. The output control of the transfer charger and separation charger can also be carried out. The respective chargers can be individually controlled by sequentially operating them and detecting a current which flows into and out of the photosensitive drum 11. This control operation can sequentially and automatically be effected in the order shown in FIG. 1 or individually be effected by the operator by designating them on the operation panel.

Various changes or modifications of the present invention may be made without departing from the spirit and scope of the present invention.

What is claimed is:

1. An apparatus for controlling an output of chargers for use in an image forming apparatus, which apparatus comprises:

an image carrying member, said image carrying member being connected to a reference potential;

charging means for building up a charge on the image carrying member;

discharging means for removing the charge which has built up on the image carrying member;

means for designating an output control mode of the charging means;

current detecting means connected between the image carrying member and the reference potential so that, when the output control mode of the charging means is designated by the designating means, the current detecting means detects a signal in accordance with the charge flowing from the image carrying member to the potential upon the charging and discharging by the charging and discharging means, respectively; and means for changing an output of the charging means so as to set the value of the detection output of the detecting means within an allowable range.

2. The apparatus according to claim 1, further comprising:

first drive means for driving said image carrying member in a given direction;

means for developing the electrostatic latent image formed on said image carrying member, using a developing agent;

means for cleaning the developing agent which is deposited on the image carrying member;

when output control of said charging means is designated by said designating means, second drive means for driving said developing means in a direction away from said image carrying member; and when the output control of said charging means is designated by said designating means, third drive means for driving the cleaning means in a direction away from the image carrying member.

3. The apparatus according to claim 1, wherein said charging means compares a detection output of said detecting means with a reference value to generate a signal value corresponding to a difference error, and further comprising means for generating a signal, which is supplied to said charging means, corresponding to the signal value which is generated by said generating means; and means for storing said reference value.

4. The apparatus according to claim 3, wherein said generating means comprises means for converting said reference value represented by a digital signal into an analog signal.

5. The apparatus according to claim 3, wherein said detecting means comprises:

means for converting a current which flows from said image carrying member into a voltage;

means for rectifying the output of the converting means; and means for smoothing the output voltage of the rectifying means.

6. The apparatus according to claim 2, wherein said designating means comprises ten keys for setting the number of copying sheets.

7. The apparatus according to claim 2, wherein said first drive means is a motor and said third drive means is a solenoid.

8. An apparatus for controlling the output of chargers, for use in an image forming apparatus which comprises:

a photoconductive member for carrying an image, said image carrying member being connected to ground;

charging means for building up a charge on the photoconductive member;

light emitting means for emitting light to remove the charge which is built up on the photoconductive member;

means for detecting a current flowing from the photoconductive member upon removal of the charge by the emitting means;

means for outputting a value corresponding to a difference error between a detection output of the detecting means and a reference value until the error reaches an allowable range; and means for generating a signal, which is supplied to the charging means in accordance with the value output from the outputting means.

9. The apparatus according to claim 8, further comprising:

first drive means for driving said image carrying member in a given direction;

means for developing the electrostatic latent image, formed on said image carrying member, by using a developing agent;

means for cleaning off the developing agent which is deposited on the image carrying member;

means for designating an output control of said charging means by the designating means;

when output control of the charging means is designated by the designating means, second drive means for driving said developing means in a direction away from the image carrying member;

when output control of said charging means is designated by the designating means, third drive means for driving the cleaning means in a direction away from the image carrying member;

means for converting a signal output from said detecting means into a digital signal; and means for storing said reference value.

10. The apparatus according to claim 8, wherein said generating means comprises means for converting said reference value which represents a digital signal into an analog signal.

11. The apparatus according to claim 9, wherein said detecting means comprises:

means for converting a current which flows from said image carrying member;

means for rectifying the voltage which is output from the converting means; and means for smoothing the output voltage of the rectifying means.

12. The apparatus according to claim 9, wherein said designating means includes tenkeys for setting the number of copying sheets.

13. The apparatus according to claim 9, wherein said first drive means is a motor and said third drive means is a solenoid.

14. A method for controlling an output of chargers which comprises the steps of:

building up a charge on image carrying member and removing the charge on the image carrying member;

detecting the current which flows from the image carrying member;

comparing an initially set reference value with the detection current;

generating a corresponding value until a difference error between the detection current and the reference value reaches a predetermined value; and generating a current corresponding to the value thus generated and building up a charge corresponding to the current on the image carrying member.

15. An apparatus for controlling the outputs of chargers, for use in an image forming apparatus which comprises:

means for carrying an image, said image carrying means including a photosensitive surface thereon;

charging means for building up a charge on the carrying means;

means for forming an electrostatic latent image on the carrying means by removing the charge on the carrying means in accordance with an original;

means for developing, using a developing agent, the electrostatic latent image formed on the carrying means;

means for transferring the developed image to a medium;

means for cleaning off any developing agent remaining on the carrying means;

discharge lamp means for removing any charge remaining on the carrying means;

means for designating an output control mode of the charging means;

current detecting means, connected between the image carrying means and a ground, so that when the output control mode is designated by the designating means, the current detecting means detects a current flowing from the image carrying means to the ground upon the removal of charge by the discharge lamp means; and means for changing an output of the charging means to as to set the value of the detection output of the current detecting means within an allowable range.

* * * * *